US008291669B2

(12) United States Patent
Karau

(10) Patent No.: US 8,291,669 B2
(45) Date of Patent: Oct. 23, 2012

(54) INTERLOCKING STRUCTURAL BLOCK AND METHOD OF MANUFACTURE

(75) Inventor: William Howard Karau, Southlake, TX (US)

(73) Assignee: Pavestone Company, LLC, Dallas, TX (US)

( * ) Notice: Subject to any disclaimer, the term of this patent is extended or adjusted under 35 U.S.C. 154(b) by 338 days.

(21) Appl. No.: 12/099,449

(22) Filed: Apr. 8, 2008

(65) Prior Publication Data

US 2009/0249734 A1 Oct. 8, 2009

(51) Int. Cl.
*E04B 5/04* (2006.01)

(52) U.S. Cl. ..... 52/609; 52/569; D25/113

(58) Field of Classification Search ..... 52/604, 52/608, 609, 569, 596, 570, 603; D25/113, D25/118

See application file for complete search history.

(56) References Cited

U.S. PATENT DOCUMENTS

| | | | | |
|---|---|---|---|---|
| 764,459 | A * | 7/1904 | Hackman | 52/591.1 |
| 894,122 | A * | 7/1908 | Dougherty | 52/302.4 |
| 1,534,353 | A | 4/1925 | Besser | |
| 1,872,522 | A | 8/1932 | Stuckey | |
| 1,941,436 | A * | 12/1933 | Haupt | 52/314 |
| 3,873,225 | A * | 3/1975 | Jakobsen et al. | 404/41 |
| 4,335,549 | A | 6/1982 | Dean, Jr. | |
| 4,627,764 | A | 12/1986 | Scheiwiller | |
| 4,973,192 | A | 11/1990 | Hair | |
| D315,026 | S | 2/1991 | Castonguay et al. | |
| 5,487,526 | A | 1/1996 | Hupp | |
| D377,181 | S | 1/1997 | Hupp | |
| D378,702 | S | 4/1997 | Blomquist et al. | |
| 5,733,470 | A | 3/1998 | Roth et al. | |
| 5,827,015 | A | 10/1998 | Woolford et al. | |
| 5,884,445 | A | 3/1999 | Woolford | |
| 6,029,943 | A | 2/2000 | Sievert | |
| 6,142,713 | A | 11/2000 | Woolford et al. | |
| D442,703 | S | 5/2001 | Fifield | |
| D448,861 | S | 10/2001 | Daniels et al. | |
| 6,668,816 | B1 | 12/2003 | Pedersen et al. | |
| D505,733 | S | 5/2005 | Castonguay et al. | |
| 6,918,715 | B2 | 7/2005 | Scherer et al. | |
| 6,944,998 | B1 * | 9/2005 | King | 52/314 |
| 7,055,517 | B1 | 6/2006 | Kitahara | |
| 7,159,367 | B1 * | 1/2007 | King | 52/314 |

(Continued)

FOREIGN PATENT DOCUMENTS

GB 948121 1/1964

OTHER PUBLICATIONS

"Haith Robot System for Aggregate Industries," http://www.hub-4.com/news/109/haith-robot-system-for-aggregate-industries, Jul. 31, 2006.

(Continued)

*Primary Examiner* — William Gilbert

(74) *Attorney, Agent, or Firm* — Jackson Walker L.L.P.; Christopher J. Rourk

(57) ABSTRACT

A structural block is provided. The structural block has a top and a bottom. A first sidewall section is between the top and the bottom. A second sidewall section is between the first sidewall section and one of the top or the bottom, and the second sidewall section is angularly disposed relative to the first sidewall section, so as to form a feature that interlocks with an adjacent structural block.

19 Claims, 6 Drawing Sheets

U.S. PATENT DOCUMENTS

| | | | | |
|---|---|---|---|---|
| 2004/0088929 | A1 * | 5/2004 | Dawson et al. | 52/102 |
| 2006/0054154 | A1 | 3/2006 | Scherer | |
| 2006/0239784 | A1 * | 10/2006 | Price et al. | 405/284 |

OTHER PUBLICATIONS

"Reconstructed Stone—Stone Pitchers," http://www.haithindustrial.co.uk/index.php?sec=cont&id=26, Jul. 31, 2006.

"Natural Stone—Block and Slab Splitting," http://www.haithindustrial.co.uk/index.php?sec=cont&id=32, Jul. 31, 2006.

"Splitting, Cutting, Marking & Layout," http://www.pavetech.com/newtools/cutting.shtm, Jul. 31, 2006.

"Stone Splitter," http://www.pavetech.com/newtools/stonesplitter.shtm, Jul. 31, 2006.

"Splitters/Turnovers," http://www.besser.com/equipment/splitters/, Aug. 3, 2006.

"Split-Face Concrete Block," http://www.toolbase.org/Technology-Inventory/walls/split-face-concrete-block, Aug. 3, 2006.

* cited by examiner

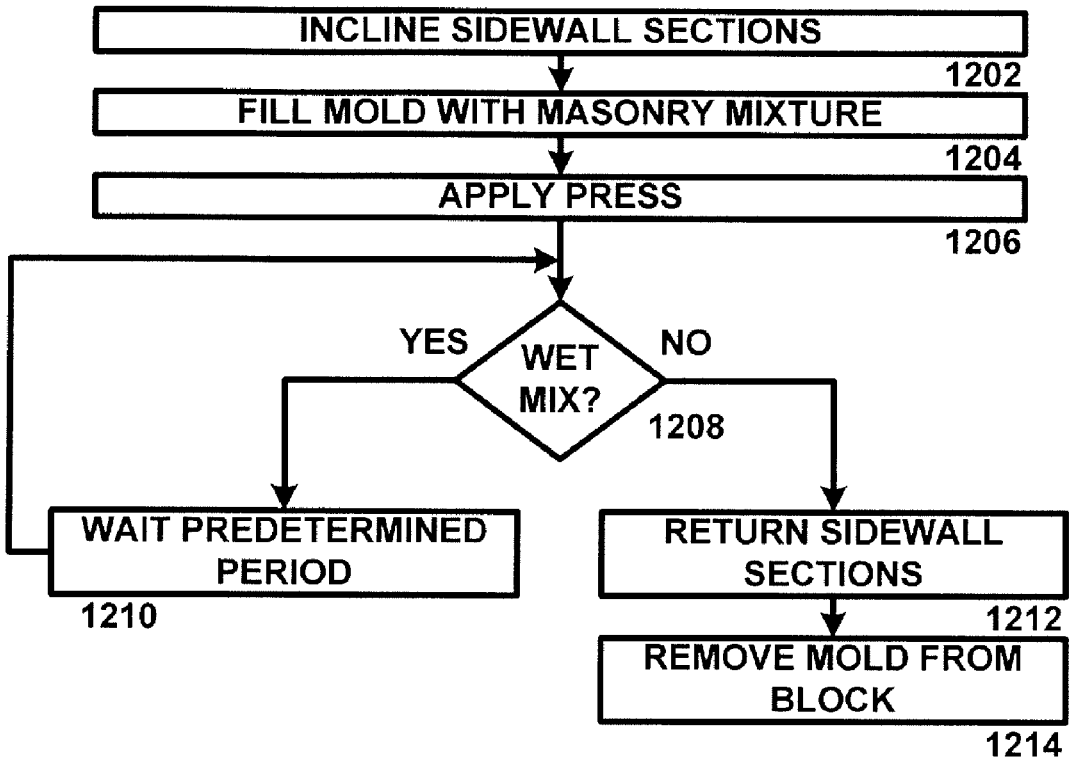
1200 FIGURE 12
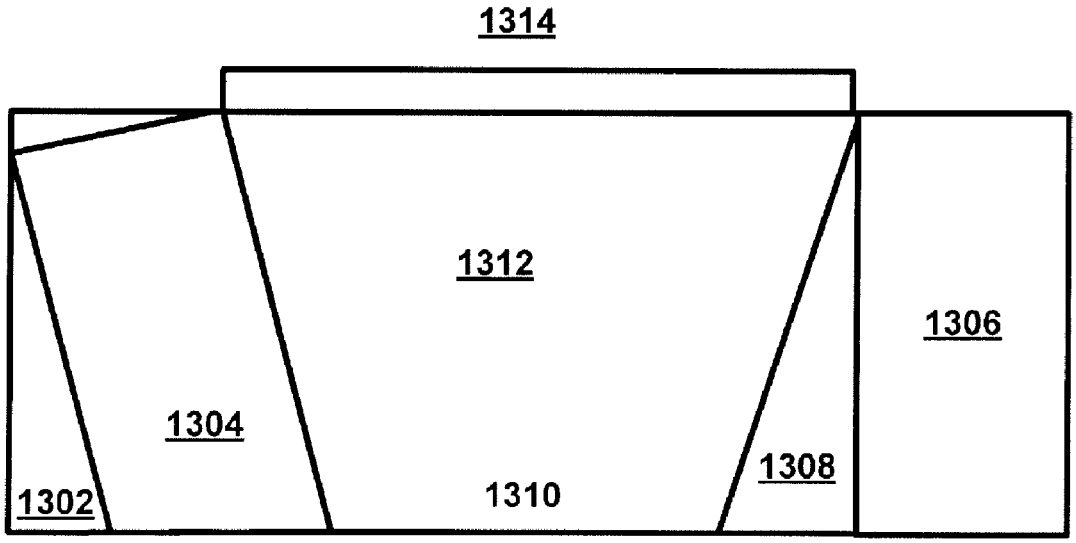
FIGURE 13 1300

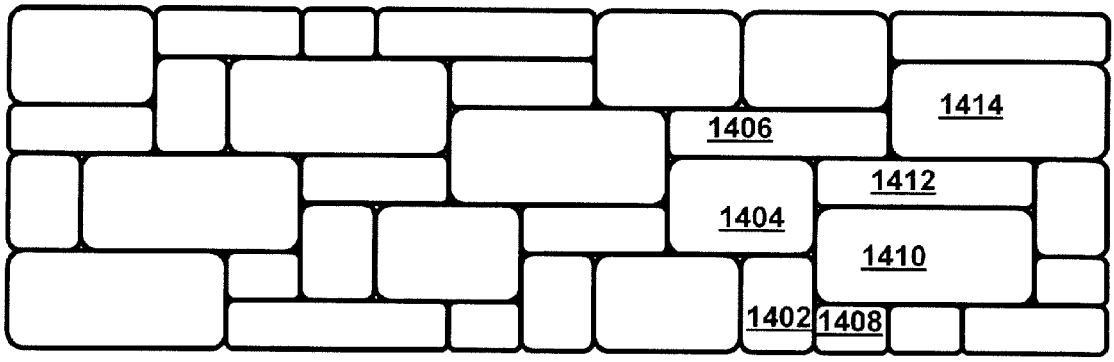
1400 FIGURE 14
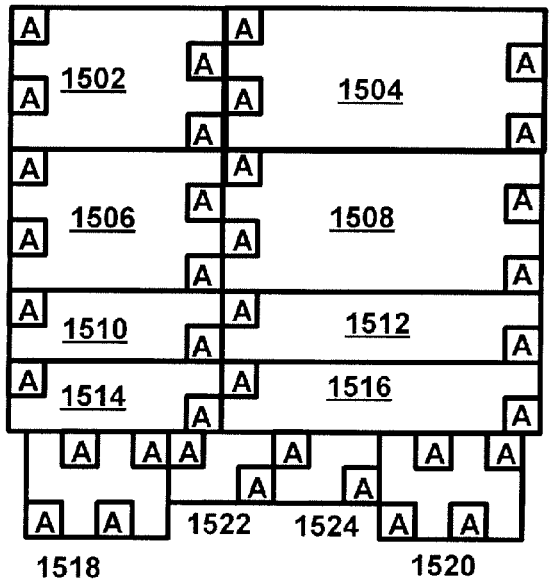
1500 FIGURE 15

INTERLOCKING STRUCTURAL BLOCK AND METHOD OF MANUFACTURE

FIELD OF THE INVENTION

The present invention pertains to the field of structural blocks, and more specifically to an interlocking structural block and method of manufacture.

BACKGROUND OF THE INVENTION

Prior art concrete blocks for retaining walls and other structures interlock using a rear lip or other structures or devices. While such structures are useful when the blocks are used for retaining walls, many applications do not require the blocks to be used for retaining walls, such that the rear lip or other structures prevent the wall from being vertical and require that the wall to be set back.

SUMMARY OF THE INVENTION

In accordance with the present invention, an interlocking structural block and method of manufacture are provided that provide an interlocking structural block that is easy to manufacture, package and install.

In accordance with an exemplary embodiment of the present invention, a structural block is provided. The structural block has a top and a bottom. A first sidewall section is between the top and the bottom. A second sidewall section is between the first sidewall section and one of the top or the bottom, and the second sidewall section is angularly disposed relative to the first sidewall section, so as to form a feature that interlocks with an adjacent structural block.

The present invention provides many important technical advantages. One important technical advantage of the present invention is a structural block that interlocks in a vertical direction, using structural components that can be formed by a mold that can be removed from the block after it is formed.

Those skilled in the art will further appreciate the advantages and superior features of the invention together with other important aspects thereof on reading the detailed description that follows in conjunction with the drawings.

BRIEF DESCRIPTION OF THE DRAWINGS

FIG. 12 is a diagram of a method for operating a mold to form interlocking sidewall faces in accordance with an exemplary embodiment of the present invention;

FIG. 13 is a diagram of a mold for forming a block in accordance with an exemplary embodiment of the present invention;

FIG. 14 is a diagram of a wall in accordance with an exemplary embodiment of the present invention; and FIG. 15 is a diagram of a mold for making multiple blocks of varying sizes in accordance with an exemplary embodiment of the present invention.

DETAILED DESCRIPTION OF PREFERRED EMBODIMENTS

Figure 1:
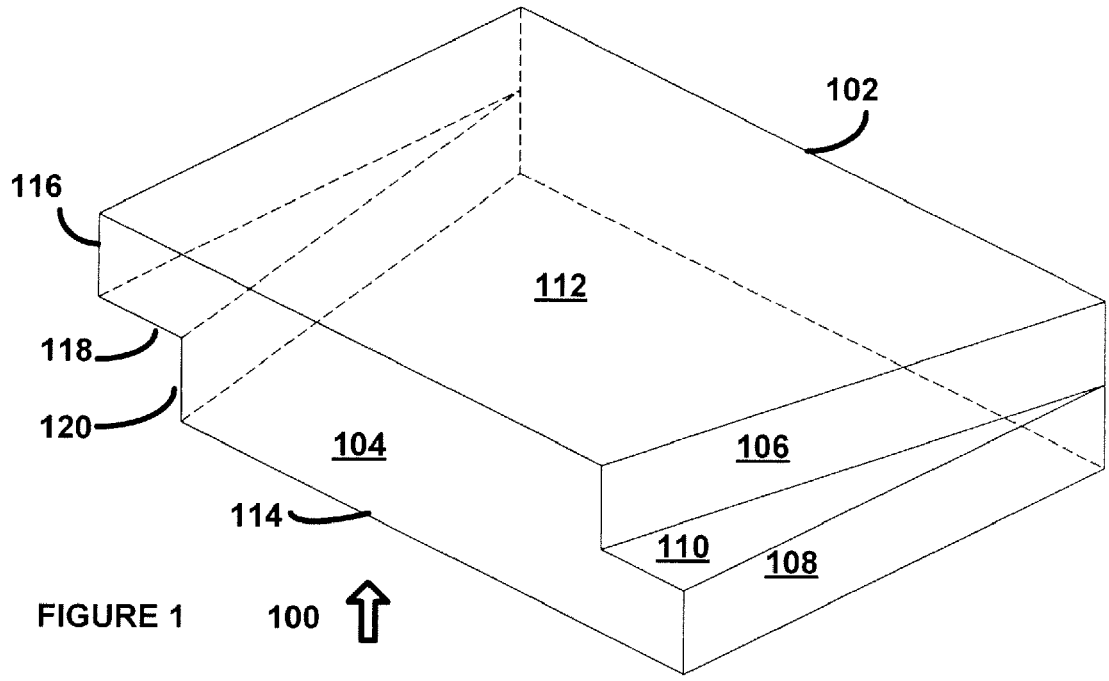
FIG. 1 is a diagram of a block in accordance with an exemplary embodiment of the present invention.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of a block 100 in accordance with an exemplary embodiment of the present invention. Block 100 can be used for retaining walls or other suitable structures.

Block 100 includes front face 102 and rear face 104. In one exemplary embodiment, front face 102 can be patterned, can be provided with a surface texture, or can be otherwise treated to provide an ornamental appearance. Rear face 104 generally remains untextured, but can also or alternatively be treated to provide an ornamental appearance.

Block 100 also includes inclined side sections 106 and 120. As shown FIG. 1, inclined side section 106 extends inward from perpendicular side section 108. Surfaces 110 and 118 allow block 100 to be interlocked with an adjacent block. In one exemplary embodiment, the depth of inclined side section 106 can be greater than the thickness of perpendicular side section 108, so as to allow ease of interlocking between adjacent blocks and to prevent problems due to manufacturing variations. In one exemplary embodiment, where the overall thickness of block 100 between bottom surface 114 and top surface 112 is six inches, the depth of inclined side section 106 can be approximately 3.1 inches and the thickness of perpendicular side section 108 can be 2.9 inches, or other suitable tolerances can be utilized to ensure that adjacent blocks will be able to interlock. The portion of the inclined side sections 106 and 120 can extend from front face 102 to rear face 104, as shown, or can extend for a lesser distance, such as where the remaining portion of inclined side sections 106 and 120 are aligned with perpendicular sidewall sections 108 and 116, or are disposed at a different angle relative to perpendicular sidewall sections 108 and 116.

In operation, block 100 allows retaining walls or other structures to be constructed where such structures have gradual curves, such as where a first block 100 is placed adjacent to a second block 100. In this exemplary embodiment, the perpendicular side section 116 of the first block 100 can be moved adjacent to the inclined side section 106 of the second block 100, such that surface 118 of the second block is on top of surface 110 of the first block. Likewise, inclined side section 120 will be adjacent to perpendicular side section 108. In this exemplary embodiment, the front face 102 of the first block and the front face 102 of the second block will meet at an obtuse angle. Likewise, the rear faces 104 of the first and second blocks 100 will meet at a reflex angle. Blocks 100 can also or alternately be placed in other suitable configurations, such as where the front faces of two adjacent blocks are in line, meet at a reflex angle, or in other suitable configurations.

Block 100 also aids in handling, as the side wedges formed by the inclined sidewalls provide a handhold for workers to readily grip and move block 100. Block 100 is also easier to package, as it can be placed adjacent to other blocks 100, such as where there is a slight offset that allows surfaces 108 and 116 to meet, which allows groups of blocks 100 to be bound without shifting. Prior art blocks have an inclined sidewall that extends from the top to the bottom of the block can not be readily bound when they are placed next to each other, as the inclined surfaces allow the prior art blocks to lean inwards towards the adjacent block when they are bound. Surfaces 108 and 116 of block 100 also aid in both horizontal alignment and placement of blocks 100 with front surfaces at a reflex angle.

Figure 2:
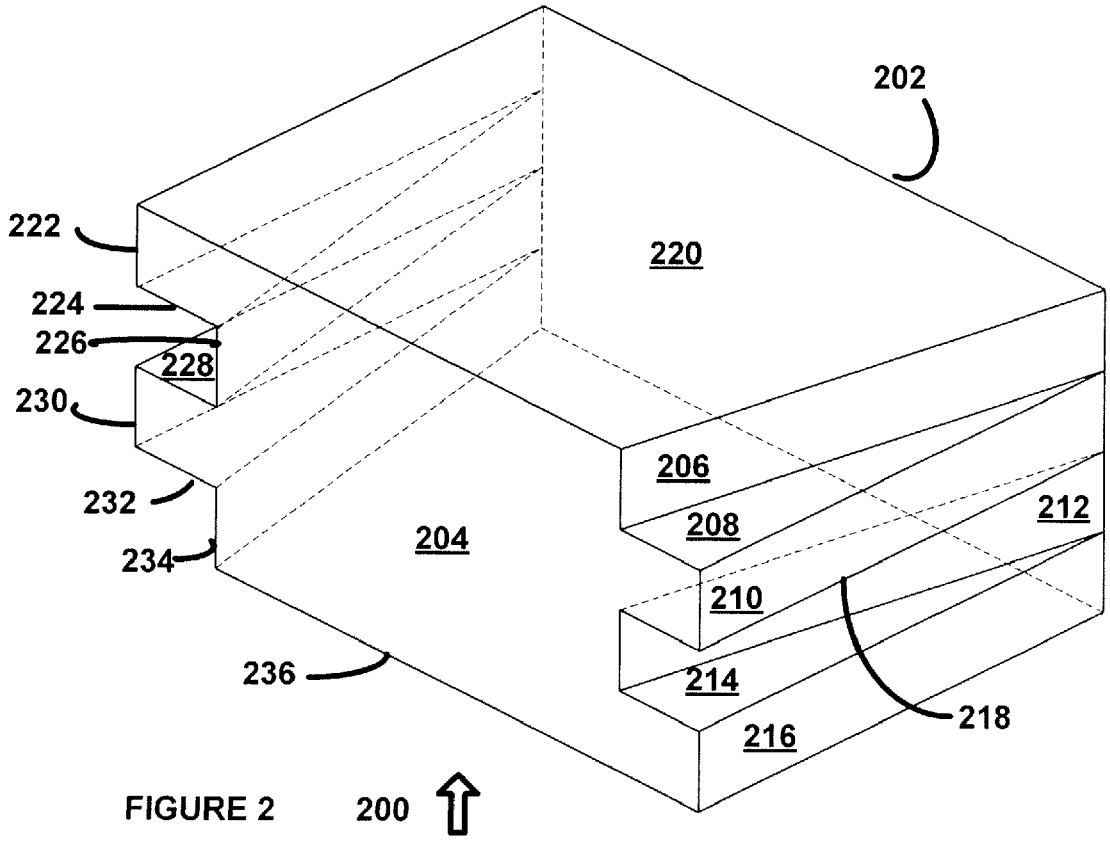
FIG. 2 is a diagram of a block in accordance with an exemplary embodiment of the present invention.

FIG. 2 is a diagram of a block 200 in accordance with an exemplary embodiment of the present invention. Block 200 includes top surface 220 and bottom surface 236, as well as front face 202 and rear face 204. The sides of block 200 include four perpendicular side surfaces 210, 216, 222 and 230, and four inclined side surfaces 206, 212, 226 and 234. The thickness of the perpendicular side surfaces 210, 216, 222 and 230 can be slightly less than the depth of the inclined side surfaces 206, 212, 226 and 234 so as to provide a tolerance to allow adjacent blocks 200 to more readily interface. In one exemplary embodiment, where a first block 200 is placed adjacent to a second block 200, the perpendicular side surfaces 222 and 230 of the first block 200 can be placed adjacent to the inclined side surfaces 206 and 212 of the second block 200, and the inclined side surfaces 226 and 234 of the first block can be placed adjacent to the perpendicular side surfaces 210 and 216 of the second block. In this manner, the wedge formed by surfaces 228 and 232 and perpendicular side surface 230 fits into the slot formed by inclined side surface 212 and perpendicular side surfaces 214 and 218. Likewise, the wedge formed by surfaces 220 and 224 and perpendicular side surface 222 fit within the space formed by inclined side surface 206 and surface 208 of the second block 200.

Block 200 can also be used in conjunction with one or more blocks 100. In one exemplary embodiment, block 100 can be placed adjacent to block 200, such that perpendicular side section 116 of block 100 can be placed in contact with inclined side surface 212 of block 200, and inclined side section 120 of block 100 can be in contact with perpendicular side surface 216 of block 200. In this exemplary embodiment, a second block 100 can be placed on top of block 100, a second block 200 can be placed on top of block 100, or other suitable configurations can be used.

In operation, block 200 allows an interlocking retaining wall or other suitable structures to be formed that interlocks when an obtuse angle is formed between front surfaces of adjacent blocks, and which also allows adjacent blocks to be placed so that the front surfaces of the adjacent blocks are planar or form a reflex angle. In this manner, block 200 can be used to form a contoured retaining wall or other suitable structures that follow a naturally occurring landscape contour, a designed landscape contour, or other suitable configurations.

Figure 3:
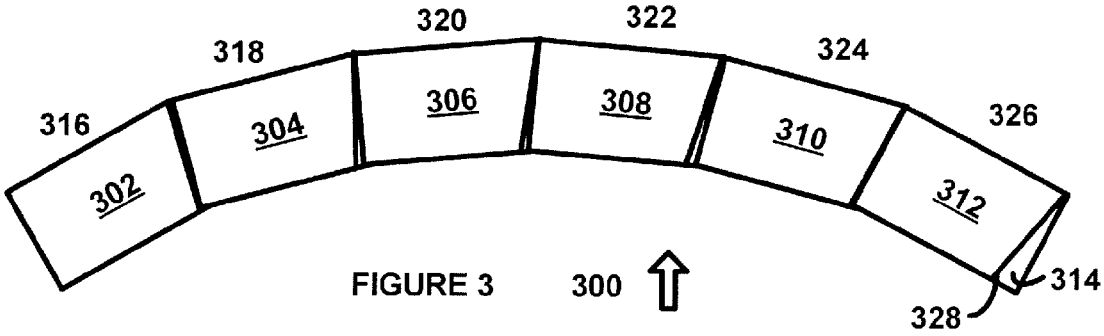
FIG. 3 is an overhead diagram of a wall in accordance with an exemplary embodiment of the present invention.

FIG. 3 is an overhead diagram of a wall 300 in accordance with an exemplary embodiment of the present invention. Wall 300 shows an exemplary configuration of blocks 100 or 200.

Wall 300 includes blocks 302 through 312, which are shown forming a slightly concave wall section. Each of blocks 302 through 312 includes interlocking side surfaces, such as those shown in FIGS. 1 and 2, so as to allow blocks 302 through 312 to be placed so that the front surfaces 316 through 326 of blocks 301 through 312 are at obtuse angles relative to the front surface of each adjacent block. In this exemplary embodiment, blocks 302 through 312 interlock so as to provide additional stability to wall 300.

Block 312 includes surface 314 and inclined side surface 328, which remain exposed, and can include additional inclined side surfaces that are not visible from an overhead view of wall 300. The inclined side surface or surfaces of block 302 is not visible in the overhead diagram of wall 300.

Figure 4:
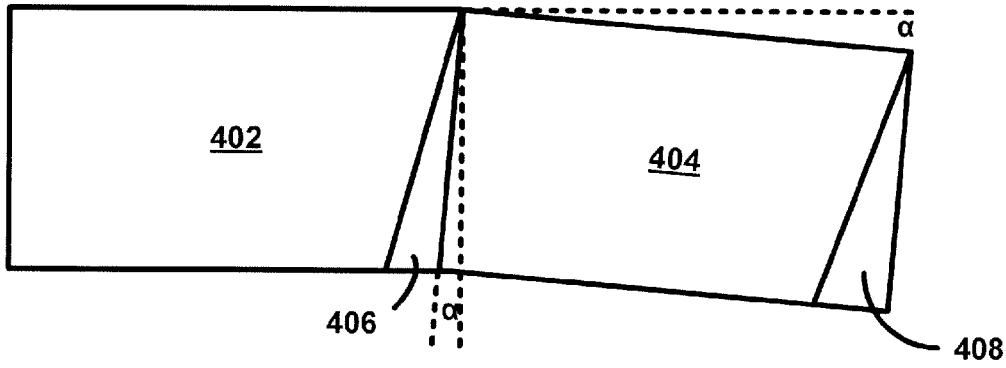
FIG. 4 is a diagram of two interlocking blocks in accordance with an exemplary embodiment of the present invention.

FIG. 4 is a diagram 400 of two interlocking blocks in accordance with an exemplary embodiment of the present invention. Block 402 is adjacent to block 404, which is overlapping with a side wall section of block 402 and 404. The angle formed by front faces 410 and 412 of blocks 402 and 404, respectively, is an obtuse angle of 180 degrees minus a. Likewise, block 404 interlocks with block 402 by the angle a. In this manner, the degree of interlocking can be adjusted so as to conform the shape of a retaining wall or other suitable structures to meet landscape design or other purposes.

Figure 5:
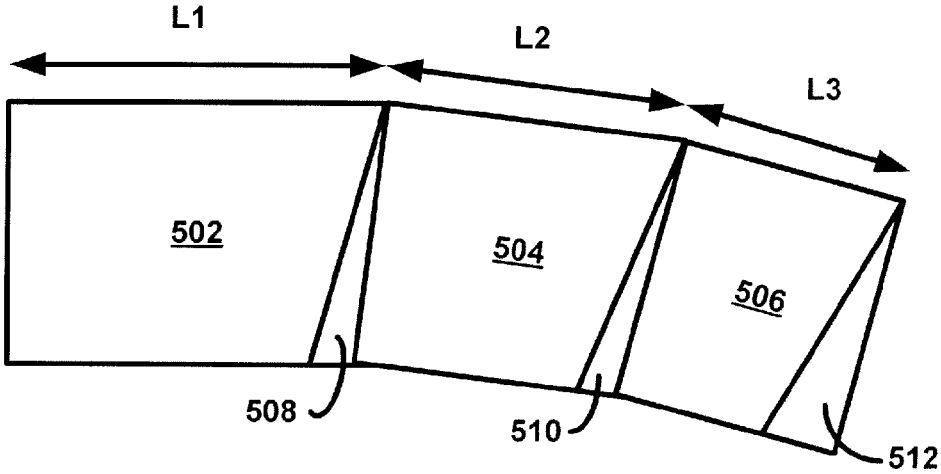
FIG. 5 is a diagram of a retaining wall section in accordance with an exemplary embodiment of the present invention.

FIG. 5 is a diagram of a retaining wall section 500 in accordance with an exemplary embodiment of the present invention. Blocks 502, 504 and 506 form a concave wall section. The length L1 of block 502 is greater than the length L2 of block 504. Likewise, the length L3 of block 506 is shorter than L1 or L2. Section 508 between block 502 and section 510 between blocks 504 and 506 remain exposed after blocks 502, 504, and 506 have been overlapped. Likewise, section 512 of block 506 is uncovered.

In this exemplary embodiment, it is shown that blocks having different lengths can be used where suitable, such as to provide a sharper turn radius for a retaining wall or other structures, to provide additional flexibility in the use of blocks having partially inclined sidewalls, or for other suitable purposes.

Figure 6:
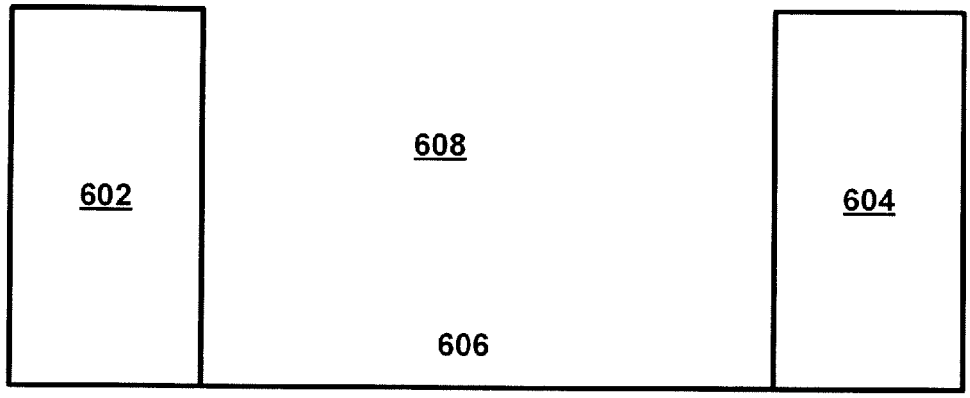
FIG. 6 is a side view of a mold in accordance with an exemplary embodiment of the present invention.

FIG. 6 is a side view of a mold 600 in accordance with an exemplary embodiment of the present invention. Mold 600 can be formed from steel, iron, plastic, or other suitable materials. Mold 600 is shown in stylized form, and in practice, a mold in accordance with the exemplary embodiments of the invention in the various FIGURES contained herein would have dimensions greater than shown to accommodate locking mechanisms for inclining sidewalls, to provide stability for stationary mold surfaces, and to provide other features.

Mold 600 includes sidewall sections 602 and 604, and mold bottom 606, which can form a front surface of a block. Mold bottom 606 can be textured, patterned or otherwise provide ornamental features to the front surface of a block, such as where mold 600 is used in a wet cast process.

One or more of sidewall sections 602 and 604 can be configured so as to be inclined, such as before mold cavity 608 is filled with a masonry compound such as wet concrete, so as to form an interlocking concrete block. In one exemplary embodiment, where mold bottom 606 forms the front surface of a block, the surface formed at the top of cavity 608 would form the back surface of the block. Sidewall sections 602 and 604 of mold 600 can be solid, hollow, or formed in other suitable manners, and can interface with the sides of mold 600 or other sidewall sections utilizing bearings, lubricants, or other suitable interfaces so as to facilitate movement before mold 600 is filled with the masonry compound and after the masonry compound has set. Likewise, mold 600 can be used in a dry mix or zero slump masonry process, where mold 600 can be removed prior to setting of the masonry compound, concrete mixture or other suitable materials.

Figure 7:
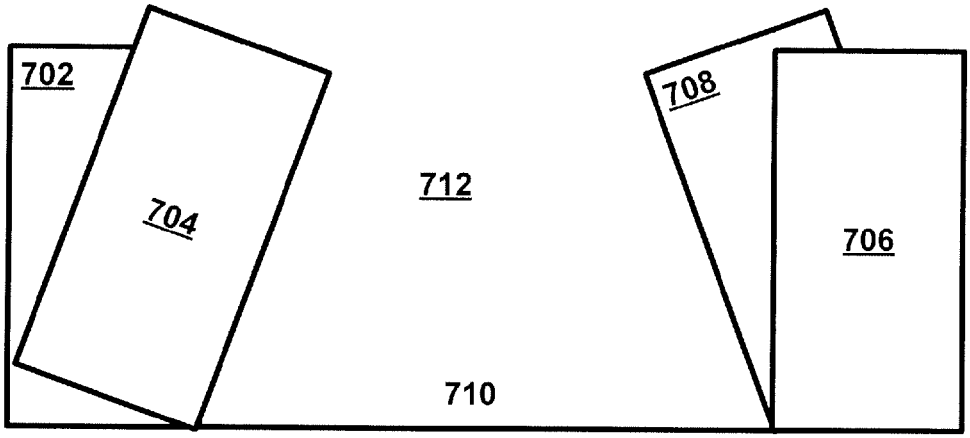
FIG. 7 is a side view of a mold in accordance with an exemplary embodiment of the present invention.

FIG. 7 is a side view of a mold 700 in accordance with an exemplary embodiment of the present invention. Mold 700 includes mold bottom 710, which can form a front surface of a block as previously described, inclining sidewall sections 704 and 708 and perpendicular sidewall sections 702 and 706. Mold cavity 712 is filled with a masonry compound such as wet concrete, which fills from the bottom up until a suitable thickness is reached. Inclining sidewall sections 704 and 708 are moved into position prior to filling.

After the masonry compound has set (for a wet mix process) or when the mold is otherwise ready for removal (such as in a dry mix or zero slump process), inclining sidewall sections 704 and 708 can be returned to their initial configuration, so as to allow mold 700 to be lifted over the block that has been formed. In this manner, the block can be removed from the mold without handling of the block, so as to reduce the risk of damage to the block and facilitate handling of the block. Alternatively, the various sidewall portions of mold 700 can be withdrawn simultaneously, in series or sequence, or in other suitable manners.

Figure 8:
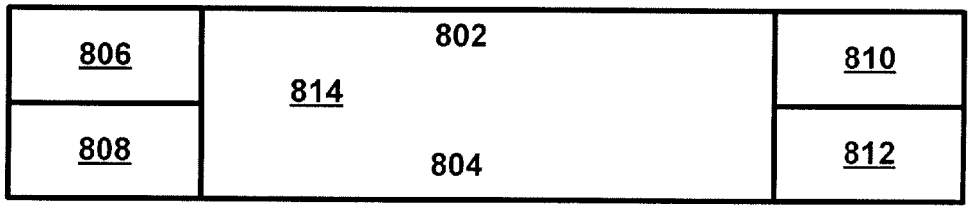
FIG. 8 is a diagram of an overhead view of a mold in accordance with an exemplary embodiment of the present invention.

FIG. 8 is a diagram of an overhead view of mold 800 in accordance with an exemplary embodiment of the present invention. Mold 800 includes top section 802 which forms the top surface of a block, bottom section 804 which forms a bottom surface of a block, and mold cavity 814. Sidewall sections 806, 808, 810, and 812 are used to contain the concrete or masonry mixture as poured or placed into mold cavity 814. In one exemplary embodiment, a plain or textured metal plate underneath mold 800 can be used to form a front face of a block, and the rear face of the block can be formed at the top of the concrete or masonry mixture placed within mold cavity 814. One or more of sidewall sections 806 through 812 can be inclined so as to form interlocking sidewall components.

Figure 9:
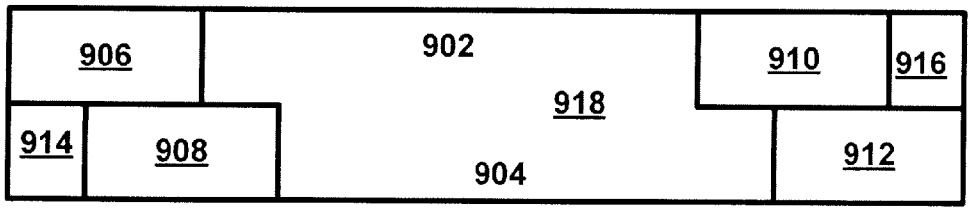
FIG. 9 is a diagram of a mold in accordance with an exemplary embodiment of the present invention.

FIG. 9 is a diagram of a mold 900 in accordance with an exemplary embodiment of the present invention. Mold 900 includes top 902, bottom 904 and mold cavity 918. Sidewall sections 906 and 912 of mold 900 are perpendicular, and sidewall sections 908 and 910 of mold 900 are inclined, such that vertical side 914 of sidewall section 908 and vertical side 916 of sidewall section 910 can be seen. Likewise, other suitable configurations can be used, such as where sidewall sections 908 and 910 utilize a locking mechanism that forces sidewall sections 908 and 910 into position when mold 900 is placed on a metal surface, and which releases sidewall sections 908 and 910 when mold 900 is lifted from the metal surface.

Figure 10:
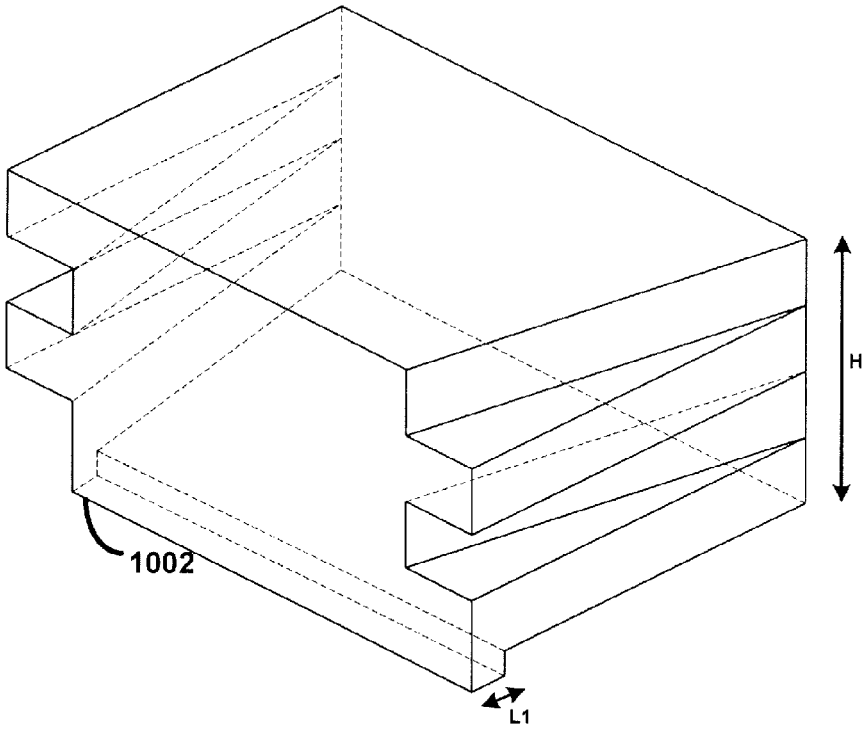
FIG. 10 is a diagram of a block in accordance with an exemplary embodiment of the present invention.

FIG. 10 is a diagram of a block 1000 in accordance with an exemplary embodiment of the present invention. Block 1000 includes lip 1002 in addition to interlocking sidewall components. Lip 1002 is shown is stylized form, and can have other suitable dimensions or locations, such as one or more angled surfaces. In one exemplary embodiment, lip 1002 can be used to provide additional stability by allowing blocks to be placed on top of each other and to interlock with lip 1002, so as to provide stability when a retaining wall is formed using block 1000. In this exemplary embodiment, a wall formed by successive layers of block 1000 will be set back on each successive layer by a distance equal to the thickness of lip 1002. Dimension L1 of lip 1002 can likewise be adjusted based on height H of block 1000, so that the amount of set back is consistent as a function of the height of block 1000. For example, where block 1000 is similar to block 100 with only one inclining side section and a shorter height, dimension L1 can be one half of the dimension L1 for a block 1000 as shown in FIG. 10, so as to result in matching setbacks when blocks of different heights are used.

Figure 11:
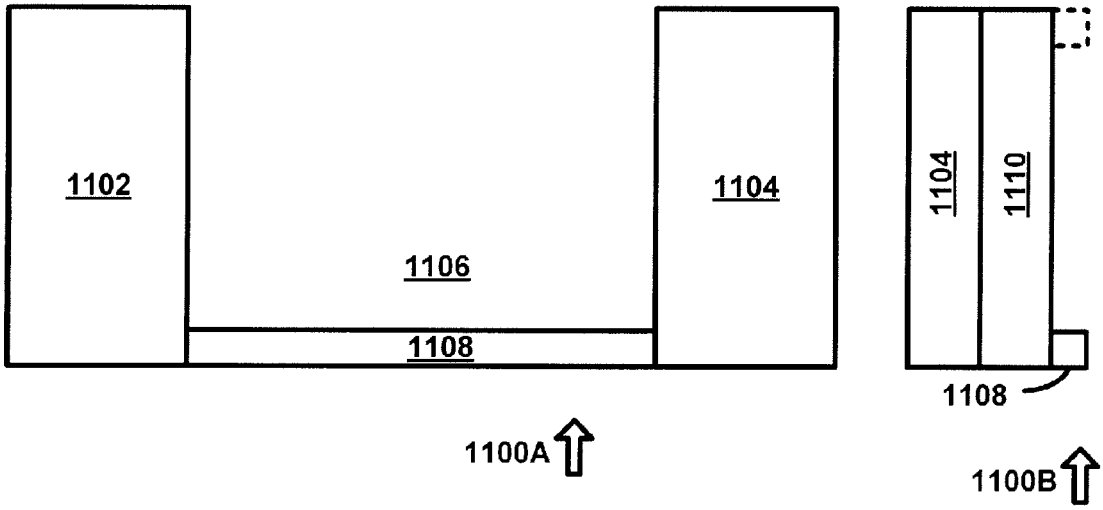
FIG. 11 is a diagram of mold views in accordance with an exemplary embodiment of the present invention.

FIG. 11 is a diagram of mold views 1100A and 1100B in accordance with an exemplary embodiment of the present invention. In view 1100A, the mold has mold cavity 1106 and lip section 1108, where the lip section 1008 is typically located along the bottom face of the rear edge of the block. In addition, sidewall sections 1102 and 1104 are provided, where one or more of sidewall sections 1102 and 1104 can be inclined. As shown in view 1100B, when a masonry mixture is poured into mold cavity 1106, the mixture flows into lip section 1108 and one or more of sidewall sections 1104, 1102, and 1110 can be inclined prior to addition of the masonry mixture so as to form an interlocking structural block with two interlocking features. Lip section 1108 can alternatively be provided at the top of the mold, as shown with dashed lines, such as where the rear face of the block is formed at the top of the mold.

FIG. 12 is a diagram of a method 1200 for operating a mold to form interlocking sidewall faces in accordance with an exemplary embodiment of the present invention. Method 1200 begins at 1202 one or more sidewall sections are inclined. In one exemplary embodiment, alternating sidewall sections can be inclined so as to form an interlocking masonry block. The sidewall sections can be inclined at the top of the mold, at the bottom of the mold, or in other suitable manners. In one exemplary embodiment, a locking mechanism can be utilized that locks the inclined sidewalls into position when a mold is placed on a metal surface, and which disengages the inclined sidewalls when the mold is removed from the metal surface. Likewise, a mechanical, hydraulic, electrical, manual or other suitable process can be used to place the inclined sidewalls into position. The inclined sidewall sections can generally be assembled prior to the introduction of masonry mixture into the mold, due to the amount of mechanical pressure that would be required to assemble the sidewall sections after the masonry mixture has been provided, or other suitable processes can be used. The method then proceeds to 1204.

At 1204, the mold is filled with a masonry mixture. In one exemplary embodiment, the masonry mixture may be wet concrete or other suitable unset masonry mixtures, dry cast or zero slump masonry, concrete or other suitable materials. The method then proceeds to 1206.

At 1206, a press is applied, where suitable. In one exemplary embodiment, where the front surface of the block is formed at the top of the mold, a press can be applied to provide an ornamental design to the front surface of the block. The method then proceeds to 1208.

At 1208, it is determined whether the masonry mixture is wet cast or some other material that does not require setting, such as a dry cast or zero slump masonry mixture. If it is determined that the masonry mixture is wet cast, the method proceeds to 1210 where a predetermined period of time is allowed to elapse. The method then returns to 1208. Likewise, if it is determined that the masonry mixture does not require setting, the method proceeds to 1212. In another alternative embodiment, 1208 can be omitted, such as in a manufacturing process where wet cast masonry mixtures are not utilized.

At 1212, the sidewall sections are returned to their perpendicular orientation, can be removed in combination with the removal of other mold components, or can be moved in other suitable manners. In one exemplary embodiment, a locking mechanism can be disabled, such as by lifting the mold from a metal surface, or other suitable mechanisms can be used. The method then proceeds to 1214, where the mold is removed from the block that has been formed, such as by lifting the mold over the press, which can remain in position until the mold has been removed. In this manner, inclined sidewall sections allow an interlocking block to be formed and also allow the mold used for forming the block to be removed without handling of the block.

FIG. 13 is a diagram of a mold 1300 for forming a block in accordance with an exemplary embodiment of the present invention. Mold 1300 can be used in dry cast or zero slump processes, where a concrete mix having a low plasticity is used to eliminate the need for the mold to remain in position during the setting period.

Mold 1300 includes vertical sidewall sections 1302 and 1306 and inclined sidewall sections 1304 and 1308. When mold 1300 is placed on an underlying metal surface, inclined sidewall sections 1304 and 1308 can be locked into position, either using a locking structure that is engaged when mold 1300 is placed on the metal surface, by a manual or mechanical locking process, or in other suitable manners. A masonry mixture is provided in mold cavity 1312, such as a dry cast or zero slump masonry mixture with low plasticity. In this exemplary embodiment, mold bottom 1310 and inclined sidewall sections 1304 and 1308 can be configured prior to the addition of the masonry mixture. Press 1314 is then applied to the masonry mixture to form the front face of the block formed by mold 1300, and can include ornamental features for application to the front face of the block. Mold 1300 can also include a rear lip along the bottom surface at the rear edge of the block, such as lip section 1108 or other suitable features.

While press 1314 is applied to the masonry mixture, inclined sidewall sections 1304 and 1308 are removed to allow the block formed by mold 1300 to be accessed. As previously discussed, inclined sidewall sections 1304 and 1308 can be held in position by a locking mechanism that releases when mold 1300 is lifted from an underlying metal surface. Likewise, a mechanical, hydraulic, electrical or manual system can be used to retract inclined sidewall sections 1304 and 1308, after which mold 1300 can be lifted while press 1314 is used to hold the formed dry cast or zero slump masonry mixture block in position, after which the block can be moved to a kiln or other suitable locations for setting of the masonry, concrete or other suitable materials.

In operation, mold 1300 can be used to form an interlocking masonry block having one or more interlocking structural components and a front face texture or other ornamental features, and can be readily removed so as to facilitate manufacture.

FIG. 14 is a diagram of a wall 1400 in accordance with an exemplary embodiment of the present invention. Wall 1400 includes blocks of varying heights and lengths, each of which can include interlocking sidewalls, a rear lip such as for use in a retaining wall, or other suitable features. In this exemplary embodiment, the utility of providing rear lips with depths in proportion to the height of the associated block can be seen from consideration of blocks 1402 through 1414. If the depth of the lip section was equal, then the bottom edge of block 1406 would not align with the bottom edge of block 1414. By increasing the depth of the lip in proportion to the height of the block, greater flexibility in the arrangement of blocks of varying sizes and shapes is provided.

FIG. 15 is a diagram of a mold 1500 for making multiple blocks of varying sizes in accordance with an exemplary embodiment of the present invention. Mold 1500 is shown in stylized form, and in practice, the dimensions of the various components of mold 1500, such as the thickness of the sidewalls between each block, would be greater than shown to accommodate locking mechanisms for inclining sidewalls and other features.

Mold 1500 includes block molds of six different widths and heights, with the largest block molds being 1504 and 1508, the smallest block molds being 1522 and 1524, and the remaining block molds (1502, 1506, 1510, 1512, 1516, 1518 and 1520) having widths and heights that range between the largest and smallest block molds. Each mold includes inclining sections A, which are used to create the inclining side sections of the blocks. In one exemplary embodiment, inclining side sections A can be configured to move into place when mold 1500 is lowered into position, and to release when mold 1500 is moved or raised, such as for use in a dry cast or zero slump casting process. Inclining sections A can incline inwards from the top or bottom of mold 1500 or in other suitable manners. Likewise, a number of textured press plates can be placed on top of mold 1500 where the top of the blocks formed by mold 1500 correspond to the front face of each of the plurality of blocks, or the bottom of mold 1500 can include texture plates where the bottom of the blocks formed in mold 1500 corresponds to the front face of each of the plurality of blocks. The texture of each different press plate or mold bottom can also be varied, so as to provide blocks having the same dimensions but different facial textures or features.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. A structural block comprising:

a top surface;

a bottom surface;

a front surface having four edges;

a rear surface comprising a first edge and a second edge opposite to the first edge, a third edge connecting the first edge to the second edge and defining a first series of an alternating protrusion and recess, and a fourth edge opposite the third edge and connecting the first edge to the second edge and defining a second series of an alternating protrusion and recess;

a first sidewall section extending from the front surface to the rear surface and disposed between the top surface and the bottom surface and defining one of the protrusion or the recess of the first series or the second series; and a second sidewall section extending from the front surface to the rear surface and disposed between the first sidewall section and one of the top surface or the bottom surface and defining the other of the protrusion or the recess of the first series or the second series, wherein the surface defining the protrusion is perpendicular to the front, rear, top and bottom surfaces.

2. The structural block of claim 1 further comprising a third sidewall section opposite from the first sidewall section.

3. The structural block of claim 1 further comprising a third sidewall section opposite from and nonparallel to the first sidewall section.

4. The structural block of claim 1 further comprising:

a third sidewall section opposite from and nonparallel to the first sidewall section; and a fourth sidewall section opposite from the second sidewall section.

5. The structural block of claim 1 further comprising:

a third sidewall section opposite from and nonparallel to the first sidewall section; and a fourth sidewall section opposite from and nonparallel to the second sidewall section.

6. The structural block of claim 1 further comprising a lip section extending below the bottom surface.

7. The structural block of claim 1 further comprising a perpendicular section extending between the first sidewall section and the second sidewall section, wherein a surface of the perpendicular section is parallel to the bottom surface and the top surface.

8. A structural block comprising:

a first sidewall section extending from a front face of the structural block, the front face having four sides, to a rear face of the structural block, the rear face comprising a first edge and a second edge opposite to the first edge, a third edge connecting the first edge to the second edge and defining a first series of an alternating protrusion and recess, and a fourth edge opposite the third edge and connecting the first edge to the second edge and defining a second series of an alternating protrusion and recess, the first sidewall section disposed between a top surface of the structural block and a bottom surface of the structural block;

a second sidewall section extending from the front face of the structural block to the rear face of the structural block and disposed between the first sidewall section and one of the top surface of the structural block or the bottom surface of the structural block, wherein a portion of the second sidewall section is non-parallel with and angularly disposed relative to the first sidewall section; and a perpendicular section extending between the first sidewall section and the second sidewall section, the first sidewall section, second sidewall section and perpendicular section form a portion of one of the protrusions, whereby one of the first sidewall section and second sidewall section is a surface that is perpendicular to the front face, the rear face, the top surface and the bottom surface.

9. The structural block of claim 8 further comprising a third sidewall section opposite from the first sidewall section.

10. The structural block of claim 8 further comprising a third sidewall section opposite from and nonparallel to the first sidewall section.

11. The structural block of claim 8 further comprising:

a third sidewall section opposite from the first sidewall section; and a fourth sidewall section opposite from the second sidewall section.

12. The structural block of claim 8 further comprising:

a third sidewall section opposite from and nonparallel to the first sidewall section; and a fourth sidewall section opposite from the second sidewall section.

13. The structural block of claim 8 further comprising:

a third sidewall section opposite from and nonparallel to the first sidewall section; and a fourth sidewall section opposite from and nonparallel to the second sidewall section.

14. The structural block of claim 8 further comprising a lip section extending below the bottom surface.

15. A structural block comprising:

a first vertical sidewall section extending from a front surface of the structural block to a rear surface of the structural block and disposed between a top surface of the structural block and a bottom surface of the structural block, where the front surface is approximately parallel to the rear surface and has a different number of sides than the rear surface;

a second vertical sidewall section extending from the front surface of the structural block to the rear surface of the structural block and disposed between the first vertical sidewall section and one of the top surface of the structural block or the bottom surface of the structural block, wherein a portion of the second vertical sidewall section is non-parallel with and angularly disposed relative to a portion of the first vertical sidewall section;

a first horizontal section extending between the first vertical sidewall section and the second vertical sidewall section;

a third vertical sidewall section opposite from the first vertical sidewall section;

a fourth vertical sidewall section opposite from the second vertical sidewall section, wherein a portion of the third vertical sidewall section is non-parallel with and angularly disposed relative to a portion of the fourth vertical sidewall section, and the portion of the first vertical sidewall section is parallel to the portion of the fourth vertical sidewall section; and a second horizontal section extending between the first vertical sidewall section and the second vertical sidewall section, the first vertical sidewall section, the second vertical sidewall section and the first horizontal section forming one of a first protrusion or a first recess, the third vertical sidewall section, the fourth vertical sidewall section and the second horizontal section forming the other of the first protrusion or the first recess, wherein the protrusion has a surface that is perpendicular to the top, bottom, front and rear surfaces.

16. The structural block of claim 15 wherein the third vertical sidewall section is opposite from and nonparallel to the first vertical sidewall section, wherein the first vertical sidewall section, the second vertical sidewall section, the third vertical sidewall section, the fourth vertical sidewall section, the first horizontal section and the second horizontal section meet to form a four-sided front face and form at least part of a rear face having at least six side edges.

17. The structural block of claim 15 wherein the fourth vertical sidewall section is opposite from and nonparallel to the second vertical sidewall section.

18. The structural block of claim 15 wherein the third vertical sidewall section is opposite from and nonparallel to the first vertical sidewall section and the fourth vertical sidewall section is opposite from and nonparallel to second vertical sidewall section.

19. The structural block of claim 15 further comprising a lip section extending below the bottom.

* * * * *

UNITED STATES PATENT AND TRADEMARK OFFICE

CERTIFICATE OF CORRECTION

PATENT NO. : 8,291,669 B2
APPLICATION NO. : 12/099449
DATED : October 23, 2012
INVENTOR(S) : William Howard Karau It is certified that error appears in the above-identified patent and that said Letters Patent is hereby corrected as shown below:

Column 10, line 55, claim 18, add “the” after “to”

Signed and Sealed this
Eleventh Day of December, 2012

David J. Kappos

David J. Kappos
*Director of the United States Patent and Trademark Office*